US009909466B2

(12) United States Patent
Koehler

(10) Patent No.: US 9,909,466 B2
(45) Date of Patent: Mar. 6, 2018

(54) CENTRAL VALVE FOR A CAMSHAFT ADJUSTER HAVING CENTRAL LOCKING

(71) Applicant: Schaeffler Technologies AG & Co. KG, Herzogenaurach (DE)

(72) Inventor: David Koehler, Egloffstein (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 15/125,055

(22) PCT Filed: Dec. 11, 2014

(86) PCT No.: PCT/DE2014/200704
§ 371 (c)(1),
(2) Date: Sep. 9, 2016

(87) PCT Pub. No.: WO2015/135515
PCT Pub. Date: Sep. 17, 2015

(65) Prior Publication Data

US 2017/0030230 A1 Feb. 2, 2017

(30) Foreign Application Priority Data

Mar. 12, 2014 (DE) ..... 10 2014 204 566

(51) Int. Cl.
*F01L 1/34* (2006.01)
*F01L 1/344* (2006.01)

(52) U.S. Cl.
CPC ... *F01L 1/3442* (2013.01); *F01L 2001/34426* (2013.01); *F01L 2001/34433* (2013.01); *F01L 2001/34453* (2013.01)

(58) Field of Classification Search
CPC ..... F01L 1/3442; F01L 2001/34433; F01L 2001/34453; F01L 2001/34426
See application file for complete search history.

(56) References Cited

U.S. PATENT DOCUMENTS

| | | | | |
|---|---|---|---|---|
| 6,267,399 | B1 | 7/2001 | Buckmiller et al. | |
| 8,006,660 | B2 | 8/2011 | Strauss et al. | |
| 8,973,544 | B2 | 3/2015 | Busse et al. | |
| 2008/0271690 | A1 * | 11/2008 | Bayrakdar | F01L 1/022 123/90.17 |
| 2012/0318221 | A1 | 12/2012 | Scheidig et al. | |

FOREIGN PATENT DOCUMENTS

| | | |
|---|---|---|
| DE | 102006031593 | 1/2008 |
| DE | 102012201567 | 8/2013 |
| DE | 102012204617 | 9/2013 |
| DE | 102012210178 | 12/2013 |
| JP | H03145507 | 6/1991 |

* cited by examiner

*Primary Examiner* — Zelalem Eshete
(74) *Attorney, Agent, or Firm* — Davidson, Davidson & Kappel, LLC

(57) ABSTRACT

A central valve (1) for a camshaft adjusting device including a control piston (2) having a first (3) and a second (4) control edge which enclose a first annular groove (6), including a valve housing (26), on the peripheral wall of which openings (14, 15, 16, 17, 18) are disposed, and including pressure medium paths extending between a feed connection and a discharge connection P, T of which the adjustable configuration is predetermined by the control edge geometry and the arrangement of the openings (14, 15, 16, 17, 18) and the adjusted configuration is dependent upon the relative axial position of the control piston (2).

10 Claims, 1 Drawing Sheet

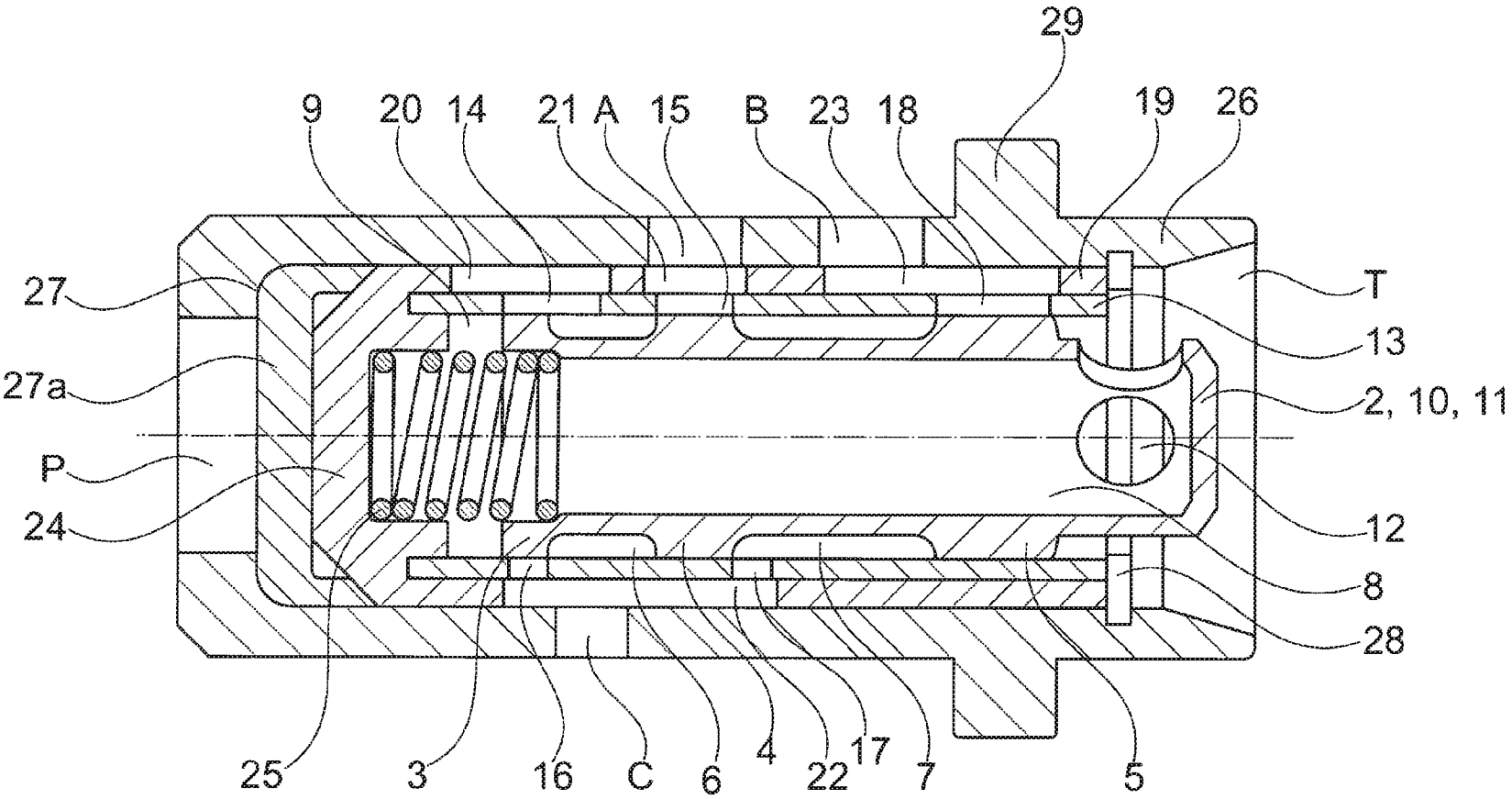
T
13
2, 10, 11
12
8
28
26
19
29
5
18
7
23
17
22
B
4
15
6
21
A
C
16
14
3
20
9
25
27
27a
P
24

CENTRAL VALVE FOR A CAMSHAFT ADJUSTER HAVING CENTRAL LOCKING

The present invention is in the field of proportional way valves which may be used, in particular, for controlling so-called camshaft adjusters. Camshaft adjusters are used to regulate the operation of an internal combustion engine by influencing the charge cycle in a targeted manner: An adjustment of the phase angle of the camshaft changes the position thereof in relation to the phase angle of the crankshaft; the opening and closing times of gas exchange valves may thus be shifted to an earlier or later point in time of the completed cycle. Central valves have multiple switching positions, with the aid of which the profile of a pressure medium path between an inlet and an outlet may be set—the pressure medium flow applies a force to the camshaft adjuster, which is dependent on the switching position and causes an adjustment into a certain position.

BACKGROUND

DE 10 2012 201 567 A1 shows a central valve of a camshaft adjuster of this type. The inflow takes place via a radial bore in the camshaft and supplies the central valve with pressure medium via its camshaft-side end. The outflow takes place via a radial bore on the valve housing. For the purpose of control, the central valve has two supply ports, with the aid of which a connection may be established between an inlet port and a working chamber of the camshaft adjuster. Refinements of camshaft adjusters of this type include additional features, for example a locking piston, which is able to mechanically fix the moving elements of the adjuster. Another supply port and an additional switching position are necessary—i.e., an extension of the central valve, with the aid of which the locking piston may be driven. One disadvantage is the elongation of the control valve following a conventional extension, which affects the required installation space.

SUMMARY OF THE INVENTION

It is an object of the present invention to provide a central valve, which has a simple structure and enhanced functionality, and simultaneously optimizes the required installation space.

Accordingly, a central valve for a camshaft adjusting device is claimed, which includes a control piston, which has a first and a second control edge, which encompass a first annular groove, a valve housing, on whose circumferential wall openings are arranged, as well as pressure medium paths, which run between an inlet and an outlet port P, T and whose settable profile is predefined by the control edge geometry and the arrangement of the openings and whose set profile depends on the relative axial length of the control piston.

Moreover—with respect to a central position of the control piston—the first control edge is assigned to a first opening and is designed to have a negative overlap with respect to the first opening in such a way that the first control edge does not cover the first opening on the side facing the second control edge, while the first control edge just closes the first opening—which transitions to an annular channel on the valve housing side—on the side facing away from the second control edge, and the second control edge is assigned to a second opening and just closes the latter on its side facing the first control edge, a third opening being assigned to the first opening, situated at an offset in the circumferential direction, and the first control edge, which is designed to have a positive overlap with respect to the third opening, just completely closing the third opening on the side facing the second control edge.

According to the finding of the present invention, the assignment of a control edge to its corresponding opening—which is considered to be required in conventional approaches—may be eliminated. Due to an ingenious arrangement of openings along the circumference, a pressure medium path is interrupted even in the case that a control edge does not cover or even completely unblocks its corresponding opening. While the pressure medium enters the area of the annular groove of the control piston via the unblocked opening, a through-flow is nevertheless suppressed in that no additional openings are unblocked. With the aid of the proposed invention, a shortening of the control edge unblocking the particular opening is facilitated. The central valve may thus perform additional functions and be simultaneously optimized with regard to its axial installation space requirements.

In one preferred specific embodiment, the first and second control edges are followed by a third control edge, which encompasses a second annular groove together with the second control edge, a fourth opening being situated at an axial offset from the first and third openings and a fifth opening from the first, second and third openings. The specific embodiment thus claimed describes a central valve which is suitable for a design as a proportional 4/5-way valve.

According to another preferred specific embodiment, the fourth opening is situated at an offset in relation to the third opening in the axial direction in such a way that the second control edge, which is designed to have a positive overlap with respect to the fourth opening, just completely unblocks the fourth opening on the side facing the third control edge. A positive control edge overlap means that the height of the control edge is greater than the width of the opening. The advantage of this specific embodiment is that it minimizes the necessary lengths of the first and second control edges.

In another preferred specific embodiment, the second and third control edges are designed to have a zero overlap with respect to the second and fifth openings, respectively, so that they close the second and fifth openings, respectively. This specific embodiment also has the advantage that the necessary length of the control edges is minimized. A zero overlap is present when the control edge terminates flush with the opening. A control edge geometry which does not terminate completely flush should also be viewed as a zero overlap. The stationary behavior of a camshaft adjuster is influenced by throttling the outflow in a targeted manner, whereby additional functions are made possible.

According to one advantageous specific embodiment, a supply port A is connected to the second opening, a supply port C is connected to the third and fourth openings, and a supply port B is connected to the fifth opening—facing outwardly in each case. The design for a proportional 4/5-way valve may be created in this way, which has proven to be advantageous to the driving of a camshaft adjuster. A design having a supply port C has proven to be particularly favorable. The camshaft adjuster may thus be driven independently of its working chambers.

In another advantageous embodiment, a pressure medium path between supply port C and outlet port T may be formed via the third opening, and a pressure medium path between supply port C and inlet port P may be formed via the fourth opening, the first opening transitioning to the annular channel, with the aid of which supply port A may be connected to an outlet port T. The claimed specific embodiment has proven to be particularly advantageous for driving camshaft adjusters which are equipped with locking pistons. Locking pistons of this type are particularly suitable, in particular, for fixing the relatively movable elements of the adjuster, particularly into an intermediate position. The proposed design of supply port C ensures that the locking piston is connected to either inlet or outlet port P, T.

According to one preferred specific embodiment of the central valve, in a first switching position, supply ports A and C are connected to inlet port P, and supply port B is connected to outlet port T, while, in a second switching position, supply port C is connected to inlet port P, and supply ports A and B are blocked by a control edge; in a third switching position, supply ports B and C are connected to inlet port P and supply port A is connected to outlet port T, while in a forth switching position, supply port C is connected to outlet port T and supply port B is connected to inlet port P and supply port A is blocked by a control edge. A design of the central valve having a corresponding geometry of the control edges is advantageous for implementing a particular switching logic, which is suitable for controlling a camshaft adjuster having central locking.

One advantageous refinement is thus to use the central valve in a camshaft adjusting device, which includes a rotor which is coaxially and rotatably situated in relation to a stator, and which includes at least one locking piston C, with the aid of which the position of the rotor in relation to the stator may be fixed in a defined position.

The central valve is preferably used to control a vane adjuster. Vane adjusters include a stator and a rotor as essential elements. The stator is rotatably fixedly connected to a drive wheel and is driven by the crankshaft via a traction mechanism drive. The rotor forms the output element.

The rotor is situated concentrically to the stator and is surrounded thereby. An indentation is situated in the stator in the circumferential direction, which is closed to form a pressure-tight cavity—without interfering with the mobility between the rotor and stator in the circumferential direction: laterally by a cover or by a side wall and on the inner diameter by the outer circumferential wall of the rotor. A vane, which is fixedly connected to the rotor and divides the cavity into two pressure-tightly closeable chambers A and B, engages with the cavity.

By connecting pressure chambers A and B to either inlet port P or outlet port T in a targeted manner, a pressure difference may be generated, whereby a force acts upon the vane. The vane is thus displaced in the circumferential direction together with the rotor.

The displacement of the rotor results in a change in the phase angle of the camshaft in relation to the phase angle of the crankshaft: If the camshaft rotates in the clockwise direction, and if pressure chamber B moves ahead of pressure chamber A, an adjustment of the vane in the direction of pressure chamber B causes an adjustment of the opening and closing times toward an earlier point in time. The phase angle of the rotor relative to the stator may be mechanically fixed in a defined position with the aid of locking piston C.

A specific embodiment is particularly preferred, in which the central valve is able to communicate with pressure chambers A and B of the camshaft adjusting device via supply ports A and B and with the at least one locking piston C via supply port C, and the at least one locking piston C is unlocked as a result of an application of pressure medium. The advantage of the specific embodiment is its switching logic, which is achievable with the aid of the claimed central valve, supply port C is connected to outlet port T only in the fourth switching position, whereby locking piston C is able to enter a locking gate and mechanically fixes the relatively movable elements of the camshaft adjuster.

According to one refinement of the central valve, the third control edge is followed by a fourth control edge, which encompasses a third annular groove together with the third control edge, a sixth opening being assigned to the third control edge. The advantage of this specific embodiment is that additional switching positions may be added to the claimed central valve. In particular, a proportional 5/5-way valve may thus be implemented.

The present invention is now explained in greater detail on the basis of one exemplary embodiment, reference being made to the drawing.

BRIEF DESCRIPTION OF THE DRAWING

FIG. 1 shows a sectional view of a control valve in a central housing.

DETAILED DESCRIPTION

FIG. 1 shows a central valve 1 including a control piston 2, whose depicted central position is clearly illustrated for the control edge geometry characteristic for the present invention. Control piston 2 includes a first, second and third control edge 3, 4, 5 as well as a first and a second annular groove 6, 7. Control piston 2 also has a hollow design, so that a pressure medium may pass through a control piston cavity 8. Inlet and outlet openings are provided on both ends for this purpose. In the illustrated specific embodiment, a front opening is situated at a first end 9, and additional openings are situated at a second end 10. The openings at second end 10 are arranged along the circumference of a piston head 11 (piston head openings 12), which has a reduced diameter with respect to the control edge sections.

Control piston 2 is axially displaceably guided in a guiding sleeve 13. Guiding sleeve 13 has a first to fifth opening(s) (14, 15, 16, 17, 18), which is/are situated at an offset. The first and third openings are situated at an offset in the circumferential direction.

Guiding sleeve 13 is extrusion-coated with plastic (plastic extrusion-coating 19). Openings are also situated on plastic extrusion-coating 19, which facilitate the transfer of the pressure medium between central valve 1 and a camshaft adjuster (not illustrated) surrounding central valve 1 (transfer opening): first through fourth transfer opening(s) (20, 21, 22, 23). Plastic extrusion-coating 19 additionally forms a spring seat 24 for a spring 25, whose force acts upon first end 9 of control piston 2.

Control piston 2 is inserted into a central housing 26, together with guiding sleeve 13 and plastic extrusion-coating 19. Within central housing 26, plastic extrusion-coating 19 is supported on a contact surface 27. A sleeve, which includes a check valve 27*a*, is also provided between plastic extrusion-coating 19 and central housing 26. A retaining ring 28 is situated on the opposite side for fixing purposes. A flange 29 is provided on central housing 26, which aligns and supports central valve 1 in a cavity of a camshaft (not illustrated), which accommodates central valve 1.

Openings which facilitate the transfer of the pressure medium between the central valve and a camshaft adjuster (housing openings) are also situated on central housing 26; the housing openings form supply ports A, B and C as well as inlet and outlet ports P and T.

Supply port A is connected to second opening 15 via second transfer opening 21;

Supply port B is connected to fifth opening 18 via fourth transfer opening 23;

Supply port C is connected to third and fourth openings, 16, 17 via third transfer opening 22; in principle, the third and fourth openings may also be connected to separate housing openings;

First transfer opening 20 is connected to first opening 14. First transfer opening 20 is closed on the housing side and thus forms an annular channel, which unblocks a pressure medium path for the pressure medium from supply port A to outlet port T via first annular groove 6, first transfer opening 14 as well as control piston cavity 8 and piston head openings 12.

In the illustrated central position, third control edge 5 covers fifth opening 18, so that supply port B is blocked. Third control edge 5 is designed to have a zero overlap with respect to fifth opening 18—the control edge terminates flush with the opening;

second control edge 4 covers second opening 15, so that supply port A is blocked. Second control edge 4 is also designed to have a zero overlap;

first control edge 3 covers third opening 16, second control edge 4 just unblocking fourth opening 17, so that supply port C may be connected to inlet port P via second annular groove 7.

A displacement of control piston 2 in the direction of first end 9 unblocks third opening 16; first control edge 3 must therefore close first opening 14 on its side facing away from second control edge 4 so that supply port C is not simultaneously connected to inlet port P and outlet port T. Moreover, supply port A is connected to inlet port P, and supply port B is connected to outlet port T. First control edge 3 is thus designed to have a negative overlap with first opening 14; the control edge height is therefore less than the width of the opening. By displacing control piston 2 in the direction of second end 10, fourth opening 17 is closed with the aid of second control edge 4, and third opening 16 is unblocked on the side facing away from first annular groove 6. The height of first control edge 3 may thus be designed in such a way that it just corresponds to the sum of the axial extensions of third and fourth openings 16, 17. The height of the control edge, i.e., its length in the axial direction, is thus minimized. In addition, supply port A is blocked and supply port B is connected to inlet port P via second annular groove 7.

LIST OF REFERENCE NUMERALS

1 central valve
2 control piston
3 first control edge
4 second control edge
5 third control edge
6 annular groove, first annular groove
7 second annular groove
8 control piston cavity
9 first end
10 second end
11 piston head
12 piston head openings
13 guiding sleeve
14 first opening
15 second opening
16 third opening
17 fourth opening
18 fifth opening
19 plastic extrusion-coating
20 first transfer opening, annular channel
21 second transfer opening
22 third transfer opening
23 fourth transfer opening
24 spring seat
25 spring
26 central housing
27 contact surface
**27*a*** check valve
28 retaining ring
29 flange
P inlet port, pressure port
T outlet port, tank port
A supply port A
B supply port B
C supply port C

The invention claimed is:

1. A central valve for a camshaft adjusting device, the central valve comprising:

a control piston having a first and a second control edge encompassing an annular groove;

a valve housing having a circumferential wall with circumferential wall openings; and pressure medium paths running between an inlet port and an outlet port, a settable profile of the pressure medium paths being predefined by the control edge geometry and the arrangement of the openings, a set profile depending on a relative axial position of the control piston, wherein—with regard to a central position of the control piston in each case—the first control edge is assigned to a first opening and is designed to have a negative overlap with the first opening in such a way that the first control edge does not cover the first opening on a side facing the second control edge, while the first control edge just closes the first opening—the first opening transitioning to an annular channel on a valve housing side—on the side facing away from the second control edge, and the second control edge is assigned to a second opening and just closes the second opening on a side facing the first control edge;

a third opening being situated at an offset from the first opening in the circumferential direction; and the first control edge has a positive overlap with the third opening and just completely closes the third opening on a side facing the second control edge.

2. The central valve as recited in claim 1 wherein the first and second control edges are followed by a third control edge encompassing a second annular groove together with the second control edge, a fourth opening being situated at an axial offset from the first and third openings and a fifth opening from the first, second and third openings.

3. The central valve as recited in claim 2 wherein the fourth opening is situated at an offset with respect to the third opening in the axial direction in such a way that the second control edge, which is designed to have a positive overlap with respect to the fourth opening, just completely unblocks the fourth opening on a side facing the third control edge.

4. The central valve as recited in claim 3 wherein the second and third control edges are designed to have a zero overlap with respect to the second and fifth openings, respectively, so that the second and third control edges close the second and fifth openings, respectively.

5. The central valve as recited in claim 4 wherein a supply port A is connected to the second opening, a supply port C is connected to the third and fourth openings, and a supply port B is connected to the fifth opening—facing outwardly in each case.

6. The central valve as recited in claim 5 wherein a pressure medium path between the supply port C and the outlet port T may be formed via the third opening, and a pressure medium path between the supply port C and the inlet port P may be formed via the fourth opening, and the first opening transitions to the annular channel, the supply port A connectable to an outlet port T with the aid of the annular channel.

7. The central valve as recited in claim 6 wherein in a first switching position, the supply ports A and C are connected to the inlet port P, and the supply port B is connected to the outlet port T;

in a second switching position, the supply port C is connected to the inlet port P, and the supply ports A and B are blocked with the aid of at least one of the first, second and third control edges;

in a third switching position, the supply ports B and C are connected to the inlet port P, and the supply port A is connected to the outlet port T; and in a fourth switching position, the supply port C is connected to the outlet port T, and the supply port B is connected to the inlet port P, and the supply port A is blocked with the aid of at least one of the first, second and third control edges.

8. The central valve as recited in claim 5 wherein the central valve is usable in a camshaft adjusting device, including a rotor which is coaxially and rotatably situated in relation to a stator, and which includes at least one locking piston C, with the aid of which the position of the rotor in relation to the stator may be fixed in a defined position.

9. The central valve as recited in claim 8 wherein the central valve is able to communicate with pressure chambers A and B of the camshaft adjusting device via the supply ports A and B and with the at least one locking piston C via the supply port C, and the at least one locking piston C is unlocked as a result of an application of pressure medium.

10. The central valve as recited in claim 3 wherein the third control edge is followed by a fourth control edge, the fourth control edge encompassing a third annular groove together with the third control edge, a sixth opening being assigned to the third control edge.

* * * * *